US012264007B2

(12) United States Patent
Suzuki et al.

(10) Patent No.: US 12,264,007 B2
(45) Date of Patent: Apr. 1, 2025

(54) DELAMINATION CONTAINER

(71) Applicant: YOSHINO KOGYOSHO CO., LTD., Tokyo (JP)

(72) Inventors: Takanori Suzuki, Tokyo (JP); Seiichi Asaoka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 239 days.

(21) Appl. No.: 17/907,211

(22) PCT Filed: Mar. 5, 2021

(86) PCT No.: PCT/JP2021/008832
§ 371 (c)(1),
(2) Date: Sep. 23, 2022

(87) PCT Pub. No.: WO2021/199925
PCT Pub. Date: Oct. 7, 2021

(65) Prior Publication Data

US 2023/0331460 A1 Oct. 19, 2023

(30) Foreign Application Priority Data

Apr. 1, 2020 (JP) ..... 2020-066090

(51) Int. Cl.
*B65D 83/00* (2006.01)
*B65D 1/02* (2006.01)

(52) U.S. Cl.
CPC ..... *B65D 83/771* (2025.01); *B65D 1/0223* (2013.01); *B65D 2501/0027* (2013.01); *B65D 2501/0081* (2013.01)

(58) Field of Classification Search
CPC ..... B65D 83/055; B65D 1/0223; B65D 2501/0027; B65D 2501/0081; B65D 2501/0036
See application file for complete search history.

(56) References Cited

U.S. PATENT DOCUMENTS

2007/0090083 A1* 4/2007 Trude ..... B65D 1/32 215/381
2010/0237036 A1* 9/2010 Trude ..... B65D 79/0084 215/381
2015/0298890 A1 10/2015 Miyairi et al.

FOREIGN PATENT DOCUMENTS

EP 4 029 798 A1 7/2022
JP 2005-186996 A 7/2005
(Continued)

OTHER PUBLICATIONS

Mar. 28, 2024 Extended European Search Report issued in European Patentn Application No. 21779973.3.
(Continued)

*Primary Examiner* — Vishal Pancholi
(74) *Attorney, Agent, or Firm* — Oliff PLC

(57) ABSTRACT

A container with separable laminated layers includes an outer layer body, an inner layer body separably laminated on an inner surface of the outer layer body and capable of undergoing volume reduction and deformation, and an ambient air inlet extending between the outer layer body and the inner layer body. The container has a bottle shape with a tubular mouth, a shoulder that is continuous with the mouth, a trunk that is continuous with the shoulder, and a bottom that is continuous with the trunk. The trunk includes a squeeze area. The squeeze area has a substantially polygonal tubular shape with three or more panel-shaped portions, and three or more corner portions that each connect adjacent panel-shaped portions.

6 Claims, 5 Drawing Sheets

(56) References Cited

FOREIGN PATENT DOCUMENTS

| | | | |
|---|---|---|---|
| JP | 3181448 | U | 2/2013 |
| JP | 2014-091539 | A | 5/2014 |
| JP | 2018-188183 | A | 11/2018 |
| JP | 2019-018892 | A | 2/2019 |
| JP | 2019-99212 | A | 6/2019 |
| JP | 2019-131254 | A | 8/2019 |
| JP | 2019-210003 | A | 12/2019 |
| JP | 2020-01802 | A | 1/2020 |
| JP | 2020-045170 | A | 3/2020 |

OTHER PUBLICATIONS

Jan. 30, 2024 Office Action issued in Japanese Patent Application No. 2020-066090.
May 18, 2021 International Search Report issued in International Patent Application No. PCT/JP2021/008832.
Sep. 29, 2022 International Preliminary Report on Patentability issued in International Patent Application No. PCT/JP2021/008832.
Jun. 25, 2024 Office Action issued in Japanese Patent Application No. 2020-066090.

* cited by examiner

DELAMINATION CONTAINER

TECHNICAL FIELD

The present disclosure relates to a container with separable laminated layers (which is also referred to as a delamination container).

BACKGROUND

As containers for storing food seasonings such as soy sauce, food such as beverages, cosmetics such as skin lotion, and toiletries such as shampoo, conditioner, or liquid soap as contents, containers with separable laminated layers are known. Such a container with separable laminated layers includes an outer layer body, an inner layer body separably laminated on an inner surface of the outer layer body and capable of undergoing volume reduction and deformation, and an ambient air inlet extending between the outer layer body and the inner layer body. In the container with separable laminated layers configured as above, after the contents are dispensed to the outside, it is possible to cause the inner layer body to undergo volume reduction and deformation in conjunction with dispensing of the contents, by introducing ambient air between the outer layer body and the inner layer body through the ambient air inlet. The contents can therefore be dispensed without being replaced by ambient air. This reduces contact between the contents stored in the inner layer body with ambient air, thereby preventing deterioration and change in quality of the contents.

Known examples of such a container with separable laminated layers include a squeeze-type container that has a bottle shape with a tubular mouth, a shoulder that is continuous with the mouth, a trunk that is continuous with the shoulder, and a bottom that is continuous with the trunk, wherein the trunk includes a flexible and restorable cylindrical squeeze area, which can be squeezed (pressed) so that the contents stored within the container are dispensed to the outside through the mouth (for example, refer to Patent Literature 1).

CITATION LIST

Patent Literature

PTL 1: JP 2019-018892 A

SUMMARY

Technical Problem

In the aforementioned existing container with separable laminated layers, however, when the squeeze area restores to its original shape after it has been squeezed so as to dispense the contents, the inner layer body sometimes may not be able to easily separate from the outer layer body in the squeeze area. There is still room for improvement in this respect.

It would be helpful to provide a squeeze-type container with separable laminated layers in which separability of the inner layer body from the outer layer body is increased.

Solution to Problem

A container with separable laminated layers according to the present disclosure includes an outer layer body, an inner layer body separably laminated on an inner surface of the outer layer body and capable of undergoing volume reduction and deformation, and an ambient air inlet extending between the outer layer body and the inner layer body, wherein the container has a bottle shape with a tubular mouth, a shoulder that is continuous with the mouth, a trunk that is continuous with the shoulder, and a bottom that is continuous with the trunk, the trunk includes a squeeze area, and the squeeze area has a substantially polygonal tubular shape with three or more panel-shaped portions, and three or more corner portions that each connect adjacent panel-shaped portions.

In a preferred embodiment of the present container with separable laminated layers configured as above, a circumferential step portion is provided between the shoulder and the squeeze area, and recesses that are concave toward an inner side of the container are provided in the step portion between the panel-shaped portions and the shoulder.

In another preferred embodiment of the present container with separable laminated layers configured as above, the container is a blow-molded product that has been formed by blow molding a preform assembly including an outer preform corresponding to the outer layer body, and an inner preform corresponding to the inner layer body that is embedded inside the outer preform.

In still another preferred embodiment of the present container with separable laminated layers configured as above, each of the panel-shaped portions is shaped so as to be curved in a circumferential direction with a predetermined curvature and to be convex toward an outer side of the container, and each of the corner portions is shaped so as to be curved in the circumferential direction with a curvature greater than the curvature of the panel-shaped portions and to be convex toward the outer side of the container.

In still another preferred embodiment of the present container with separable laminated layers configured as above, each of the panel-shaped portions is shaped so as to extend linearly in a circumferential direction, and each of the corner portions is shaped so as to be curved in the circumferential direction with a predetermined curvature and to be convex toward an outer side of the container.

In still another preferred embodiment of the present container with separable laminated layers configured as above, the squeeze area has a substantially barrel shape wherein part thereof between one end and another end in an axial direction protrudes radially outward.

In still another preferred embodiment of the present container with separable laminated layers configured as above, the ambient air inlet is provided in the mouth.

Advantageous Effect

According to the present disclosure, a squeeze-type container with separable laminated layers in which separability of the inner layer body from the outer layer body is increased can be provided.

DETAILED DESCRIPTION

Hereinafter, a container 1 with separable laminated layers according to an embodiment of the present disclosure will be described in detail by illustration with reference to the drawings.

Figure 1:
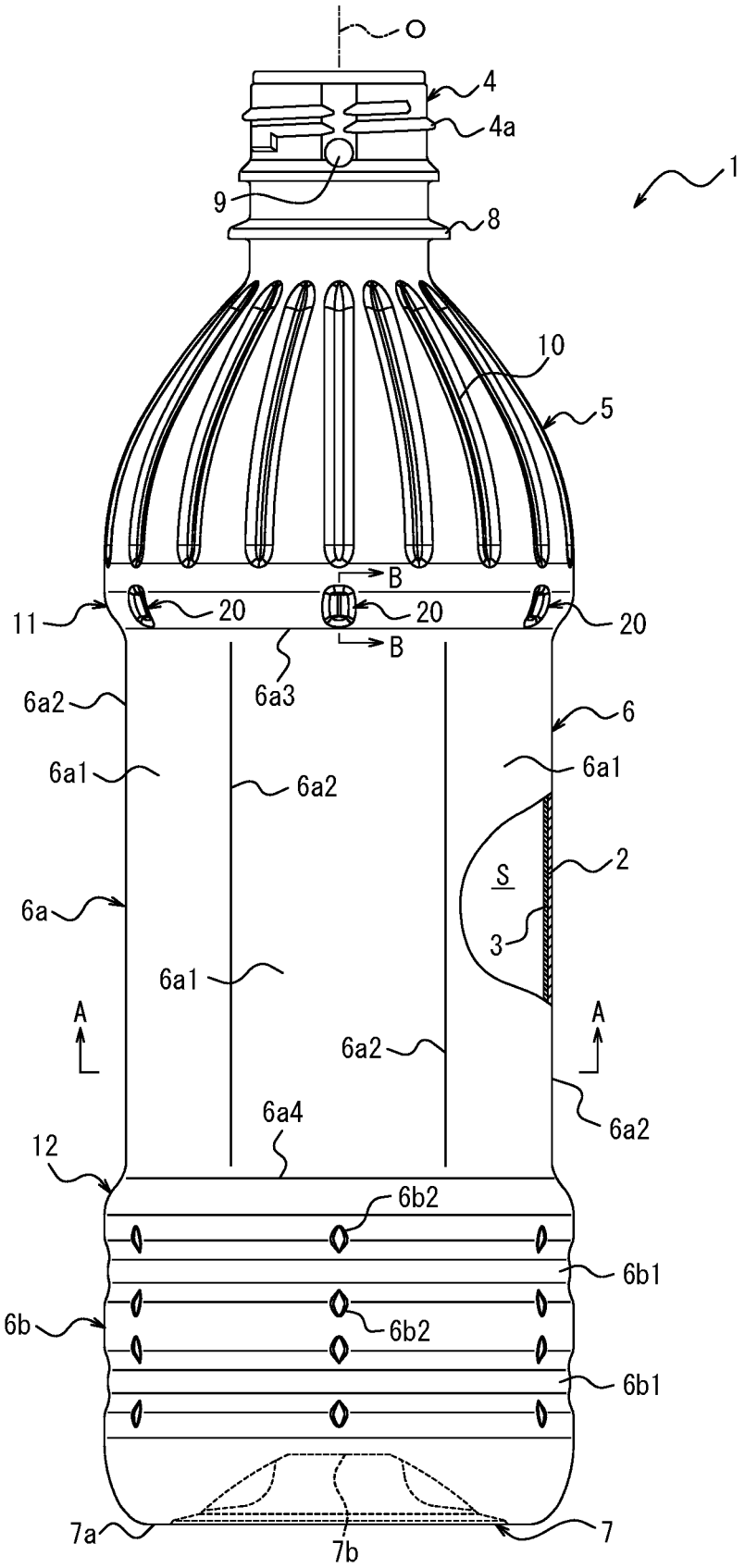
FIG. 1 is a front view illustrating a container with separable laminated layers according to an embodiment of the present disclosure.

In the present specification and claims, a vertical direction means an up and down direction (a direction in which an axis O extends) in a state in which the container 1 with separable laminated layers is in an upright position as illustrated in FIG. 1, and a radial direction means a direction that passes the axis O of container 1 with separable laminated layers and that is perpendicular to the axis O.

The container 1 with separable laminated layers of FIG. 1 is a squeeze-type container that can be used, for example, to store various types of contents, including food seasonings such as soy sauce, food such as beverages, cosmetics such as skin lotion, and toiletries such as shampoo, conditioner, or liquid soap. The container 1 with separable laminated layers has a double-layer structure including an outer layer body 2 and an inner layer body 3.

The outer layer body 2 defines an outer shell of the container 1 with separable laminated layers, and it is made of polyethylene terephthalate (PET) resin in the present embodiment. It is to be noted that the outer layer body 2 is not limited to a single layer structure. The outer layer body 2, which is configured using polyethylene terephthalate resin as the main material, may have a structure made of a plurality of layers, in order to improve its barrier properties or the like.

In the present embodiment, the inner layer body 3 is also made of polyethylene terephthalate (PET) resin. The inner layer body 3 is formed in a bag shape having a thickness smaller than that of the outer layer body 2. The inner layer body 3 is separably laminated on an inner surface of the outer layer body 2. Separation of the inner layer body 3 from the inner surface of the outer layer body 2 may be any of separation from a bonded state, separation from a quasi-bonded state, and separation from a close contact state. A storage space S is defined within the inner layer body. The contents can be stored in the storage space S. In conjunction with dispensing of the contents from the storage space S to the outside, the inner layer body 3 can undergo volume reduction and deformation so as to reduce its internal volume, while separating from the inner surface of the outer layer body 2. It is to be noted that the inner layer body 3 is also not limited to a single layer structure. The inner layer body 3, which is configured using polyethylene terephthalate resin as the main material, may have a structure made of a plurality of layers, in order to improve its barrier properties or the like.

In the present embodiment, the container 1 with separable laminated layers is made of polyethylene terephthalate resin, with both the outer layer body 2 and the inner layer body 3 being formed using biaxially stretchable polyethylene terephthalate resin. Examples of such polyethylene terephthalate resin include homo PET. Other types of PET, such as isophthalic acid (IPA) modified PET or CHDM modified PET, can also be used. Polyethylene terephthalate resin that forms the outer layer body 2 and polyethylene terephthalate resin that forms the inner layer body 3 may have the same composition or different compositions.

Since the outer layer body 2 and the inner layer body 3 are made of polyethylene terephthalate resin, the container 1 with separable laminated layers can be formed lightweight, strong, and highly transparent.

It is to be noted that the outer layer body 2 and the inner layer body 3 are not necessarily made of polyethylene terephthalate resin, and they may be made of another synthetic resin material, such as polypropylene (PP) or polyethylene (PE).

The container 1 with separable laminated layers has a bottle shape with the mouth 4, a shoulder 5 that is continuous with a lower end of the mouth 4, a trunk 6 that is continuous with a lower end of the shoulder 5, and a bottom 7 that is continuous with a lower end of the trunk 6.

The mouth 4 has a substantially cylindrical shape centered around the axis O, and a male thread **4*a* is integrally provided on its outer peripheral surface. A member, such as a dispensing cap, may be fitted to the male thread 4*a*. A neck ring 8 is also integrally provided below the male thread 4*a* of the mouth 4**.

The outer peripheral surface of the mouth 4 may be provided with a projection, instead of the male thread **4*a*, so that the mouth 4 can be capped with a member, such as a dispensing cap, by undercut engagement. Further, the neck ring 8** may also be omitted.

The mouth 4 is provided with an ambient air inlet 9. In the embodiment, the ambient air inlet 9 is provided in part of the outer layer body 2 that constitutes the mouth 4, as a through hole passing through the outer layer body 2 in the radial direction. The ambient air inlet 9 extends between the outer layer body 2 and the inner layer body 3, and as the inner layer body 3 separates from the outer layer body 2, ambient air can be introduced between the outer layer body 2 and the inner layer body 3.

The shoulder 5 has a shape that gradually increases in diameter downward. In the present embodiment, the shoulder 5 has a dome shape that is convex toward an outer side of the container. The shoulder 5 has a substantially circular sectional shape perpendicular to the axis O.

The shoulder 5 is provided with a plurality of concave ribs (18 concave ribs) 10, which are arranged at regular intervals in the circumferential direction (for convenience, only a single concave rib is denoted by a reference numeral in FIG. 1). Each of these concave ribs 10 has a groove shape concave toward the inner side of the container while extending in the vertical direction.

By configuring the shoulder 5 with the plurality of concave ribs 10, a passage for ambient air is easily formed from the ambient air inlet 9 provided in the mouth 4 to the trunk 6 between the outer layer body 2 and the inner layer body 3. The inner layer body 3 can therefore easily separate from the outer layer body 2.

The shape of the shoulder 5, which gradually increases in diameter downward, may be changed in various ways. Further, the shoulder 5 may be configured without concave ribs 10.

The trunk 6 has a substantially cylindrical shape as a whole, and it includes a squeeze area **6*a* and a reinforced area 6*b***.

The squeeze area **6*a* is provided in a predetermined area of the trunk 6 in the vertical direction that is located near the shoulder 5. The squeeze area 6*a* is flexible and can elastically deform radially inward (toward the inner side of the container) upon being squeezed (pressed) radially inward. That is, in the container 1 with separable laminated layers, by squeezing (pressing) the squeeze area 6***a* of the trunk 6 toward the inner side of the container, the contents stored in the storage space S can be pushed and dispensed to the outside through the mouth 4. The squeeze area 6*a* is flexible and can also restore to the original shape from the deformed state when the squeeze is released. Additionally, no circumferential ribs are provided in the squeeze area 6*a*.

The bottom 7 includes a ring-shaped ground contacting portion 7*a* that extends around the axis O, and a bottom panel 7*b* that is located inward of the ground contacting portion 7*a*. The bottom 7 closes the lower end of the trunk 6.

The container 1 with separable laminated layers configured as above is a blow-molded product.

In the present embodiment, the container 1 with separable laminated layers is a blow-molded product that has been formed by biaxially stretch blow molding a preform assembly having a double-layer structure in which an outer preform and an inner preform are combined. The outer preform has been formed by injection molding polyethylene terephthalate resin. The inner preform has been formed independently of the outer preform, by injection molding polyethylene terephthalate resin. The outer preform corresponds to the outer layer body 2, and the inner preform corresponds to the inner layer body 3.

In a case in which the container 1 with separable laminated layers is a blow-molded product that has been formed by biaxially stretch blow molding the aforementioned preform assembly, the mouth 4 is configured with a non-biaxially stretch blow molded part of the inner layer body 3 that is located radially inward of a non-biaxially stretch blow molded part of the outer layer body 2.

Since the container 1 with separable laminated layers is a blow-molded product that has been formed by blow molding the preform assembly including the outer preform corresponding to the outer layer body 2, and the inner preform corresponding to the inner layer body 3 that is embedded inside the outer preform, the container 1 with separable laminated layers can be formed easily and precisely.

It is to be noted that the container 1 with separable laminated layers may also be formed by biaxially stretch blow molding a preform with laminated layers that is configured with laminated synthetic resin materials corresponding to the outer layer body 2 and the inner layer body 3.

Further, the container 1 with separable laminated layers may also be formed by subjecting a cylindrical parison with laminated synthetic resin materials corresponding to the outer layer body 2 and the inner layer body 3 to extrusion blow molding (EBM) in which blow molding is performed using a splittable mold.

Figure 2:
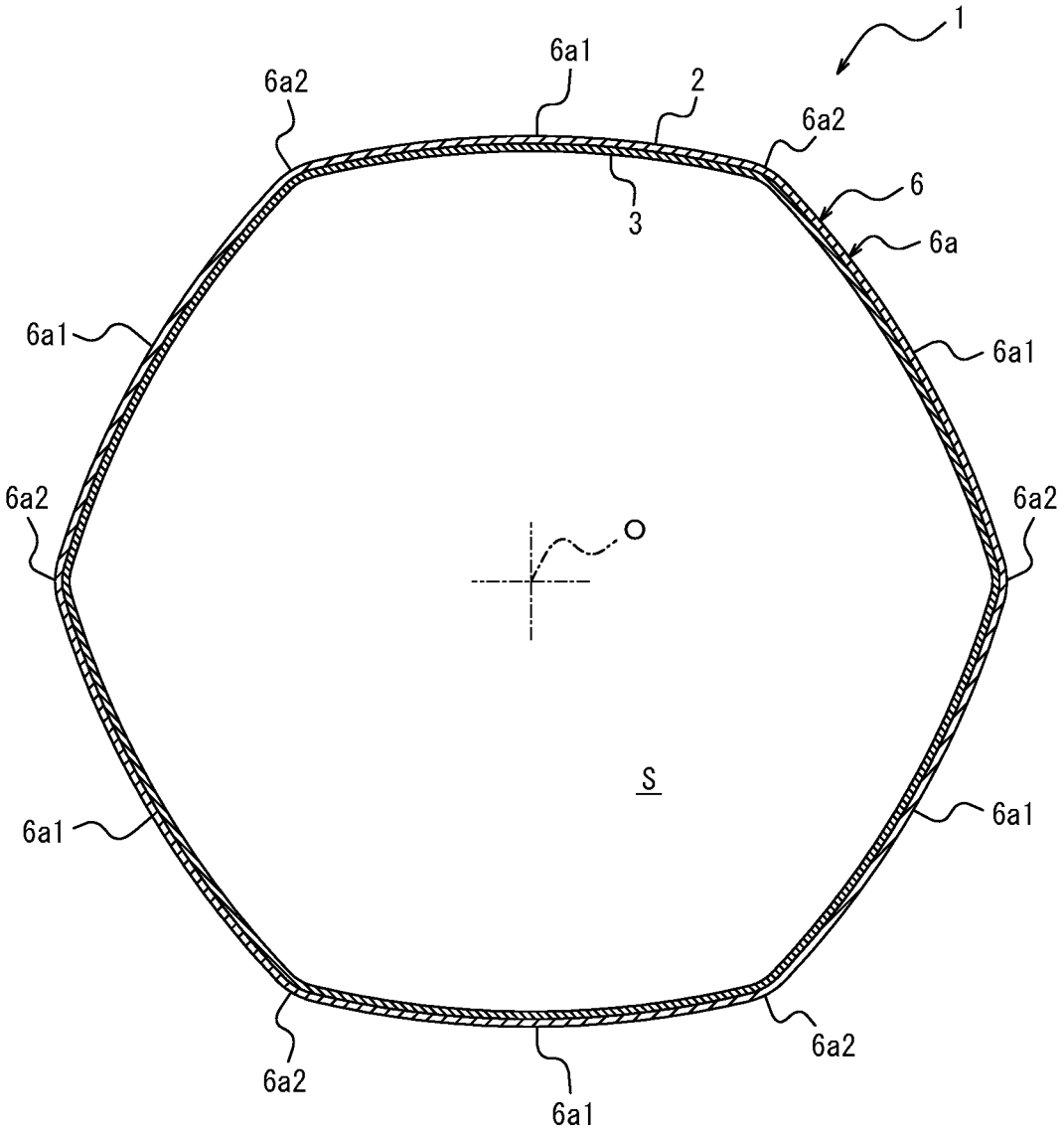
FIG. 2 is a sectional view taken along line A-A of the container with separable laminated layers of FIG. 1.

In the container 1 with separable laminated layers according to the present embodiment, as illustrated in FIG. 1 and FIG. 2, the squeeze area 6*a* has a substantially polygonal tubular shape with three or more panel-shaped portions 6*a*1, and three or more corner portions 6*a*2 that each connect adjacent panel-shaped portions 6*a*1. The squeeze area 6*a* is preferably configured with six to eight panel-shaped portions 6*a*1 and six to eight corner portions 6*a*2. In the present embodiment, the squeeze area 6*a* includes six panel-shaped portions 6*a*1 and six corner portions 6*a*2 that each connect adjacent panel-shaped portions 6*a*1, and it has a polygonal tubular shape with a substantially hexagonal cross-section (section perpendicular to the axis O).

As illustrated in FIG. 2, in the present embodiment, each of the six panel-shaped portions 6*a*1 is shaped so as to have an arc-shaped cross-section that is curved in the circumferential direction with a predetermined curvature and that is convex toward the outer side of the container. The six panel-shaped portions 6*a*1 have the same length in the circumferential direction around the axis O, and they are arranged at regular intervals in the circumferential direction around the axis O. Further, the radius of the cross-section of the panel-shaped portions 6*a*1 is larger than the distance from the axis O to each panel-shaped portion 6*a*1. On the other hand, each of the six corner portions 6*a*2 is shaped so as to have an arc-shaped cross-section that is curved in the circumferential direction and that is convex toward the outer side of the container. The curvature of each corner portion 6*a*2 is larger than that of each panel-shaped portion 6*a*1. Accordingly, in the squeeze area 6*a*, the inner layer body 3 separates from the outer layer body 2 more easily in the panel-shaped portions 6*a*1 than in the corner portions 6*a*2.

Consequently, after the squeeze area 6*a* is squeezed so as to dispense the contents, when the squeeze is released and the squeeze area 6*a* is restored to the original shape from the deformed state, it is ensured that the inner layer body 3 can be separated from the outer layer body 2 in the panel-shaped portions 6*a*1 in which the inner layer body 3 is more easily separable.

Thus, in the container 1 with separable laminated layers according to the present embodiment, the squeeze area 6*a* provided in the trunk 6 has a substantially polygonal tubular shape with three or more panel-shaped portions 6*a*1, and three or more corner portions 6*a*2 that each connect adjacent panel-shaped portions 6*a*1. This increases separability of the inner layer body 3 from the outer layer body 2 in the squeeze area 6*a* compared with a case in which the squeeze area 6*a* has a cylindrical shape. As a result, it is ensured that the inner layer body 3 can be separated from the outer layer body 2 in conjunction with dispensing of the contents. The squeeze-type container 1 with separable laminated layers can therefore provide increased dispensing operability for dispensing the contents.

In particular, in a case in which the container 1 with separable laminated layers is a blow-molded product in which the outer layer body 2 and inner layer body 3 are made of polyethylene terephthalate resin as in the present embodiment, the inner layer body 3 is less likely to separate from the outer layer body 2. Even in such a case, however, since the squeeze area 6*a* provided in the trunk 6 is configured in a substantially polygonal tubular shape with three or more panel-shaped portions 6*a*1, and three or more corner portions 6*a*2 that each connect adjacent panel-shaped portions 6*al*, it is ensured that the inner layer body 3 can be separated from the outer layer body 2 in conjunction with dispensing of the contents. The squeeze-type container 1 with separable laminated layers can therefore provide increased dispensing operability for dispensing the contents.

Further, in the present embodiment, each panel-shaped portion 6*a*1 is shaped so as to be curved in the circumferential direction with a predetermined curvature and to be convex toward the outer side of the container, and each corner portion 6*a*2 is shaped so as to be curved in the circumferential direction with a curvature greater than that of the panel-shaped portions 6*a*1 and to be convex toward the outer side of the container. Accordingly, the panel-shaped portions 6*a*1 are preferentially separated compared with the corner portions 6*a*2, and therefore, separability of the inner layer body 3 from the outer layer body 2 can be increased. At the same time, the squeeze area 6*a* can acquire an increased ability to restore to the original shape after it has undergone radially inward deformation in response to squeeze. This allows the squeeze area 6*a* to quickly restore to the original shape when the squeeze is released after dispensing the contents, so that squeeze-type container 1 with separable laminated layers can provide even more increased dispensing operability for dispensing the contents.

As illustrated in FIG. 1, in the present embodiment, an upper end 6*a*3 of the squeeze area 6*a* is located radially inward of the lower end of the shoulder 5. A circumferential step portion 11 is formed around the axis O between the upper end 6*a*3 of the squeeze area 6*a* and the lower end of the shoulder 5. That is, the upper end 6*a*3 of the squeeze area 6*a* is continuous with the lower end of the shoulder 5 via the circumferential step portion 11.

In the present embodiment, the step portion 11 has a curved shape that gradually decreases in diameter in a direction from the shoulder 5 toward the squeeze area 6*a* and that is convex toward the outer side of the container. This increases rigidity of the step portion 11, so that when the squeeze area 6*a* is squeezed, deformation of the step portion 11 or the shoulder 5, along with the squeeze area 6*a*, can be prevented. The squeeze-type container 1 with separable laminated layers can therefore provide increased dispensing operability for dispensing the contents.

Recesses 20 that are concave toward the inner side of the container are provided in the step portion 11 between the six panel-shaped portions 6*a*1 and the shoulder 5. Because in the present embodiment the six panel-shaped portions 6*a*1 are provided in the squeeze area 6*a* at regular intervals in the circumferential direction, six recesses 20 are correspondingly provided in the step portion 11 at regular intervals in the circumferential direction. Each recess 20 is located above the circumferentially center position of the corresponding panel-shaped portion 6*a*1. Additionally, only three recesses 20 are illustrated in FIG. 1.

Figure 3:
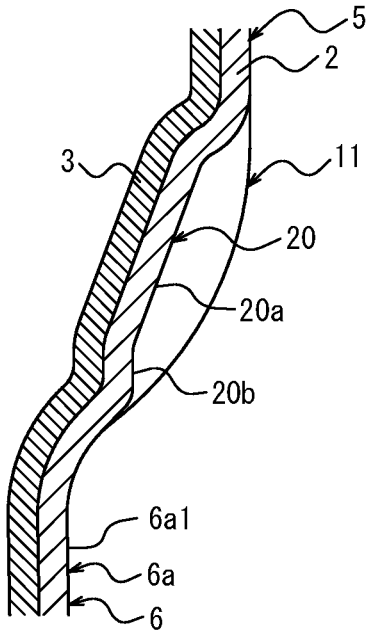
FIG. 3 is a sectional view taken along line B-B of the container with separable laminated layers of FIG. 1.

As illustrated in FIG. 3, for example, each of these recesses 20 includes a bottom wall 20*a* with a flat longitudinal sectional shape, and a curved peripheral wall 20*b* that surrounds the periphery of the bottom wall 20*a*. The bottom wall 20*a* is continuous with an outer peripheral surface of the step portion 11 via the curved peripheral wall 20*b*. Each recess 20 is formed in a longitudinal rib shape extending in a direction from the shoulder 5 toward the trunk 6. Additionally, the peripheral wall 20*b* may be an inclined linear wall extending from the outer peripheral surface of the step portion 11 toward the bottom wall 20*a*.

When the contents are dispensed and the inner layer body 3 undergoes volume reduction and deformation relative to the outer layer body 2, the inner layer body 3 starts to collapse from parts of the step portion 11 at which the recesses 20 are provided. The inner layer body 3 can therefore easily separate from the outer layer body 2 in the parts of the step portion 11 at which the recesses 20 are provided. Further, since the recesses 20 are provided between the panel-shaped portions 6*a*1 and the shoulder 5, when the inner layer body 3 separates from the outer layer body 2 in the parts of the step portion 11 at which the recesses 20 are provided, the inner layer body 3 can accordingly easily separate from the outer layer body 2 in the panel-shaped portions 6*a*1 as well.

Thus, in the container 1 with separable laminated layers according to the present embodiment, the recesses 20 that are concave toward the inner side of the container are provided between the respective panel-shaped portions 6*a*1 and the shoulder 5 in the circumferential step portion 11 formed between the shoulder 5 and the squeeze area 6*a* of the trunk 6. Accordingly, when the contents are dispensed and the inner layer body 3 undergoes volume reduction and deformation relative to the outer layer body 2, the inner layer body 3 starts to collapse from the recesses 20, so that the inner layer body 3 can easily separate from the outer layer body 2 in the step portion 11. Moreover, the inner layer body 3 can accordingly easily separate from the outer layer body 2 in the panel-shaped portions 6*a*1 located in correspondence with the recesses 20. Consequently, even when the container 1 with separable laminated layers is configured with the circumferential step portion 11 formed between the shoulder 5 and the squeeze area 6*a*, a passage for ambient air can be formed straight from the ambient air inlet 9 provided in the mouth 4 to the trunk 6, and the inner layer body 3 can easily separate from the outer layer body 2 during dispensing of the contents. The container 1 with separable laminated layers can therefore even further increase separability of the inner layer body 3 from the outer layer body 2, while providing increased dispensing operability for the contents.

In particular, in a case in which the container 1 with separable laminated layers is a blow molded product in which the outer layer body 2 and the inner layer body 3 are made of polyethylene terephthalate resin as in the present embodiment, the inner layer body 3 is less likely to separate from the outer layer body 2 in the step portion 11. Nevertheless, by providing the recesses 20 in the step portion 11 as in the present embodiment, the inner layer body 3 can easily separate from the outer layer body 2 in the step portion 11 even in such a container 1 with separable laminated layers.

As illustrated in FIG. 1, the reinforced area 6*b* of the trunk 6 has a substantially cylindrical shape having a diameter larger than that of the squeeze area 6*a*, and two annular ribs 6*b*1 are provided on its outer peripheral surface. The two annular ribs 6*b*1 each have a concave groove shape extending in the circumferential direction. With the two annular ribs 6*b*1, the reinforced area 6*b* has a higher rigidity in the radial direction than the squeeze area 6*a*.

An upper end of the reinforced area 6*b* protrudes radially further outward than a lower end 6*a*4 of the squeeze area 6*a*. A circumferential secondary step portion 12 is also provided around the axis O between the upper end of the reinforced area 6*b* and the lower end 6*a*4 of the squeeze area 6*a*. That is, the upper end of the reinforced area 6*b* is continuous with the lower end 6*a*4 of the squeeze area 6*a* via the secondary step portion 12.

By providing the trunk 6 with the reinforced area 6*b* that is continuous with the lower end 6*a*4 of the squeeze area 6*a* via the secondary step portion 12, the lower end 6*a*4 of the squeeze area 6*a* is firmly supported by the reinforced area 6*b* via the secondary step portion 12. Accordingly, the dispensing operability of the squeeze area 6*a* can be increased.

Additionally, a plurality of depressed portions 6*b*2 may be provided at regular intervals in the circumferential direction on both sides of each annular rib 6*b*1.

Figure 4:
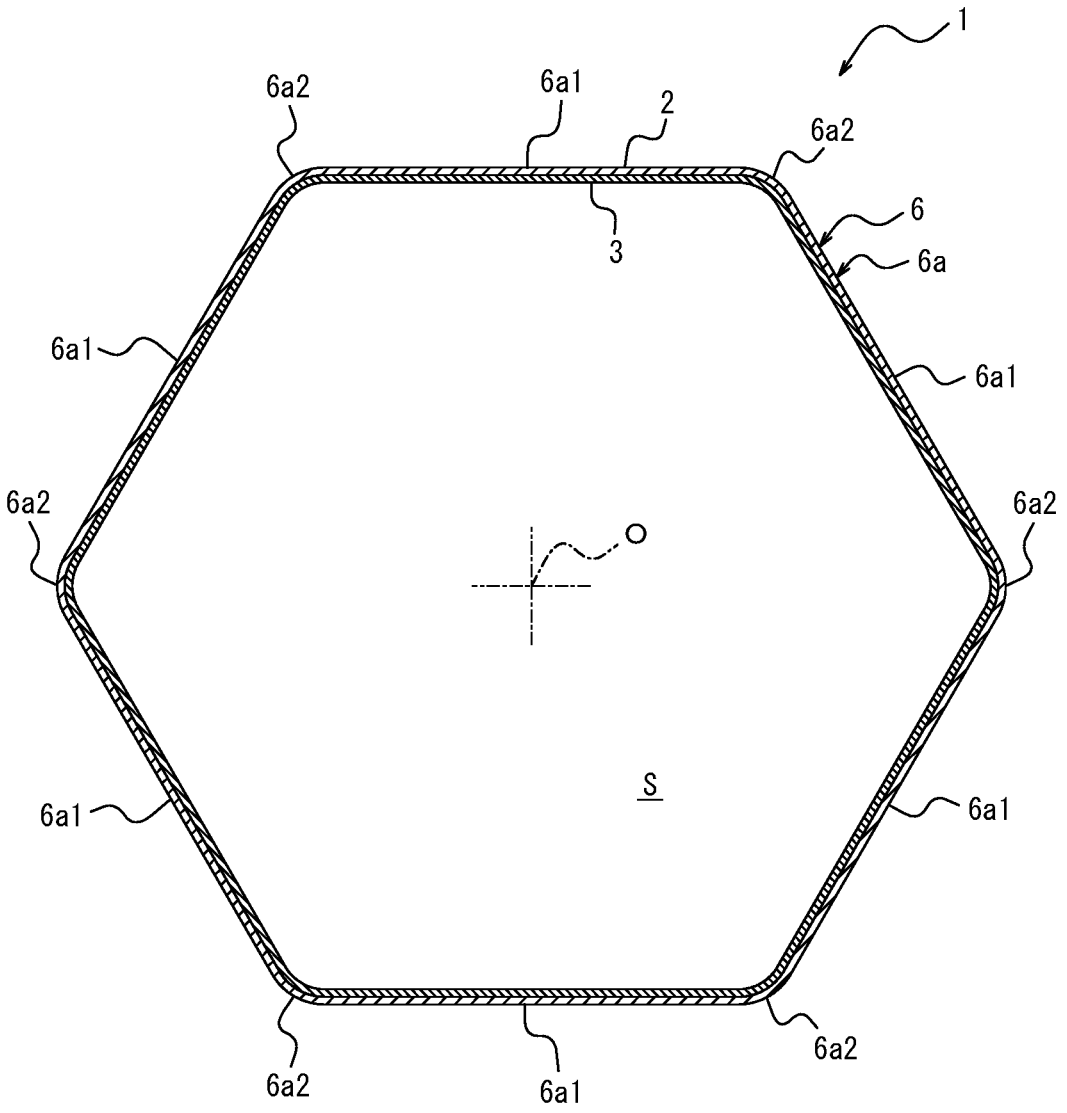
FIG. 4 is a sectional view illustrating part of a squeeze area according to a modification that corresponds to FIG. 2.

As illustrated in FIG. 4 as a modification, in the squeeze area 6*a*, each panel-shaped portion 6*a*1 may be shaped so as to extend linearly in the circumferential direction, and each corner portion 6*a*2 may be shaped so as to be curved in the circumferential direction with a predetermined curvature and to be convex toward the outer side of the container.

Consequently, the squeeze area 6*a* may be configured to be more easily squeezed (pressed).

Figure 5:
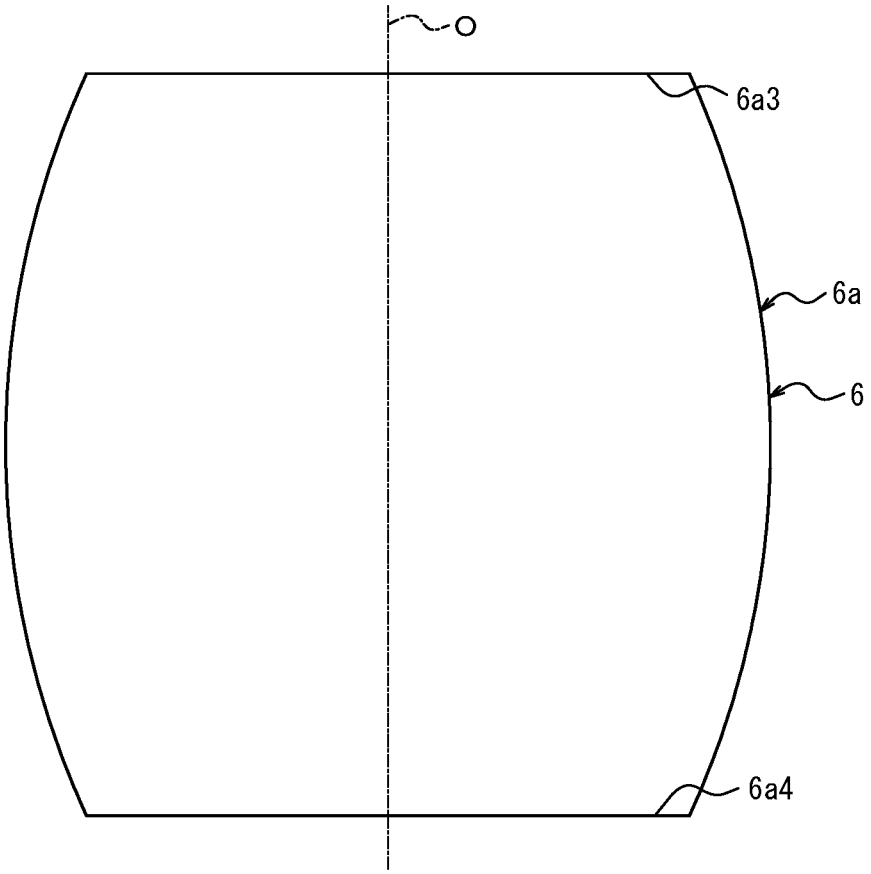
FIG. 5 schematically illustrates an outward appearance of a squeeze area according to another modification.

As illustrated in FIG. 5 as another modification, the squeeze area 6*a* may have a substantially barrel shape wherein part thereof between the upper end 6*a*3, which is one end in the axial direction, and the lower end 6*a*4, which is the other end in the axial direction, protrudes radially outward. That is, the squeeze area 6*a* may have a longitudinal sectional shape passing through the axis O that is curved so as to be convex radially outward between the upper end 6a3 and the lower end 6a4.

Consequently, the squeeze area 6a can acquire an increased ability to restore to the original shape after it has undergone radially inward deformation in response to squeeze. This allows the squeeze area 6a to quickly restore to the original shape when the squeeze is released after squeezing the squeeze area 6a and dispensing the contents, so that squeeze-type container 1 with separable laminated layers can provide even more increased dispensing operability for dispensing the contents.

The present disclosure is not limited to the above embodiment, and various modifications can be made without departing from the gist of the present disclosure.

For example, although in the above embodiment the squeeze area 6a is configured with six panel-shaped portions 6a1 and six corner sections 6a2 that each connect adjacent panel-shaped portions 6a1, it is sufficient that the number of panel-shaped portions 6a1 and the number of corner portions 6a2 are both three or more, and these numbers may be changed in various ways.

Further, although in the above embodiment the step portion 11 is provided between the shoulder 5 and the squeeze area 6a, and the plurality of recesses 20 is provided in the step portion 11, the present disclosure is not limited to this, The step portion 11 or the recesses 20 may be omitted.

Moreover, although in the above embodiment the ambient air inlet 9 is provided in part of the outer layer body 2 that constitutes the mouth 4, as a through hole passing through this part in the radial direction, the present disclosure is not limited to this. The ambient air inlet 9, which is configured to allow ambient air to be introduced between the outer layer body 2 and the inner layer body 3, may be provided in any of the shoulder 5, the trunk 6, and the bottom 7. The ambient air inlet 9 may also be in the form of a slit, or a gap that opens at the boundary between the outer layer body 2 and the inner layer body 3, without being limited to a through hole.

REFERENCE SIGNS LIST

1 Container with separable laminated layers
2 Outer layer body
3 Inner layer body
4 Mouth
4a Male thread
5 Shoulder
6 Trunk
6a Squeeze area
6a1 Panel-shaped portion
6a2 Corner portion
6a3 Upper end
6a4 Lower end
6b Reinforced area
6b1 Annular rib
6b2 Depressed portion
7 Bottom
7a Ground contacting portion
7b Bottom panel
8 Neck ring
9 Ambient air inlet
10 Concave rib
11 Step portion
12 Secondary step portion
20 Recess
20a Bottom wall
20b Peripheral wall
O Axis
S Storage space

The invention claimed is:

1. A container with separable laminated layers comprising an outer layer body, an inner layer body separably laminated on an inner surface of the outer layer body and capable of undergoing volume reduction and deformation, and an ambient air inlet extending between the outer layer body and the inner layer body, wherein the container has a bottle shape with a tubular mouth, a shoulder that is continuous with the mouth, a trunk that is continuous with the shoulder, and a bottom that is continuous with the trunk, the trunk includes a squeeze area, the squeeze area has a substantially polygonal tubular shape with three or more panel-shaped portions, and three or more corner portions that each connect adjacent panel-shaped portions, a circumferential step portion is provided between the shoulder and the squeeze area, recesses formed in a longitudinal rib shape and that are concave toward an inner side of the container are provided in the step portion between the panel-shaped portions and the shoulder, and each of the recesses is provided at a center of a respective one of the panel-shaped portions in the circumferential direction.

2. The container with separable laminated layers according to claim 1, wherein the container is a blow-molded product that has been formed by blow molding a preform assembly including an outer preform corresponding to the outer layer body, and an inner preform corresponding to the inner layer body that is embedded inside the outer preform.

3. The container with separable laminated layers according to claim 1, wherein each of the panel-shaped portions is shaped so as to be curved in a circumferential direction with a predetermined curvature and to be convex toward an outer side of the container, and each of the corner portions is shaped so as to be curved in the circumferential direction with a curvature greater than the curvature of the panel-shaped portions and to be convex toward the outer side of the container.

4. The container with separable laminated layers according to claim 1, wherein each of the panel-shaped portions is shaped so as to extend linearly in a circumferential direction, and each of the corner portions is shaped so as to be curved in the circumferential direction with a predetermined curvature and to be convex toward an outer side of the container.

5. The container with separable laminated layers according to claim 1, wherein the squeeze area has a substantially barrel shape wherein part thereof between one end and another end in an axial direction protrudes radially outward.

6. The container with separable laminated layers according to claim 1, wherein the ambient air inlet is provided in the mouth.

* * * * *